US005675969A

United States Patent [19]

Satoh

[11] Patent Number: 5,675,969

[45] Date of Patent: Oct. 14, 1997

[54] EXHAUST GAS CONTROL DEVICE IN AN INTERNAL COMBUSTION ENGINE

[75] Inventor: Yasuaki Satoh, Fujisawa, Japan

[73] Assignee: Fuji Oozx Inc., Japan

[21] Appl. No.: 651,968

[22] Filed: May 21, 1996

[51] Int. Cl.[6] ..... F01N 7/00

[52] U.S. Cl. ..... 60/324; 123/323

[58] Field of Search ..... 60/324; 123/323

[56] References Cited

U.S. PATENT DOCUMENTS

| | | | |
|---|---|---|---|
| 2,369,175 | 2/1945 | Prince | 60/602 X |
| 3,234,924 | 2/1966 | May | 60/324 |
| 4,571,820 | 2/1986 | Matsumoto et al. | 29/426.1 |
| 4,682,674 | 7/1987 | Schmidt | 60/324 |
| 4,707,987 | 11/1987 | Aktin | 60/324 |
| 4,773,440 | 9/1988 | Yanagawa et al. | 123/323 |
| 5,355,673 | 10/1994 | Sterling et al. | 60/324 |
| 5,603,214 | 2/1997 | Abels et al. | 60/324 |

FOREIGN PATENT DOCUMENTS 0 153 427 9/1985 European Pat. Off. .

*Primary Examiner*—Sheldon J. Richter

*Attorney, Agent, or Firm*—Zarley, McKee, Thomte, Voorhees & Sease

[57] ABSTRACT

An exhaust gas control device is provided in an internal combustion engine. In the device, a valve which comprises a valve head and a valve stem is provided in a body the axis of which is inclined at 45 degrees with respect to a horizontal exhaust pipe. The valve is moved up and down in the body by compressed air and a coil spring. When the valve is engaged on a valve seat in the exhaust pipe, the exhaust pipe is closed, so that exhaust gas flows through a by-pass pipe. When the exhaust pipe is opened, exhaust gas flows through the exhaust pipe, thereby improving engine performance.

5 Claims, 1 Drawing Sheet

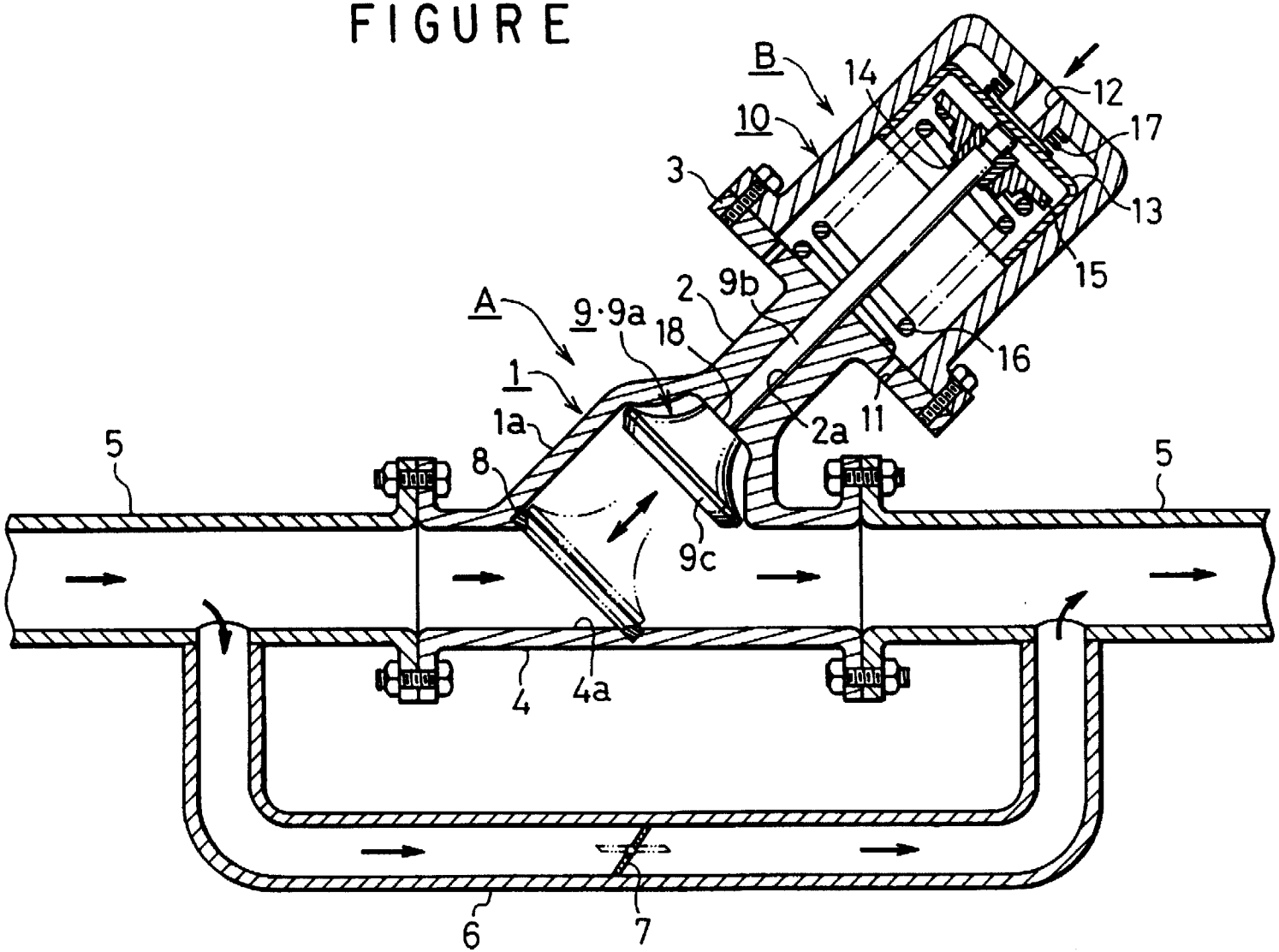
FIGURE

EXHAUST GAS CONTROL DEVICE IN AN INTERNAL COMBUSTION ENGINE

BACKGROUND OF THE INVENTION

The present invention relates to an exhaust gas control device in an internal combustion engine, the device being provided in an exhaust system to control flow rate of exhaust gas.

As such a control device, there are exhaust gas flow rate control valves which are, for example, provided on an exhaust pipe to control flow pate of exhaust gas depending on rotation speed of an engine, thereby increasing engine capability from low speed area to high speed area, and butterfly valves for an exhaust brake.

In such exhaust flow rate control valves and butterfly valves, valve discs themselves are provided in exhaust pipes, and opened and closed therein. However, the valve elements are opened and closed in the exhaust pipes to prevent smooth flow of exhaust gas and increase exhaust resistance when the valve is opened, thereby decreasing durability of the pipes.

SUMMARY OF THE INVENTION

To overcome the disadvantage, it is an object of the present invention to provide an exhaust gas control device in an internal combustion engine, a valve element being completely withdrawn from a path for exhaust gas, thereby reducing exhaust resistance remarkably.

To achieve the object, according to the present invention, there is provided an exhaust gas control device in an internal combustion engine, the device comprising a body in which an axis is inclined at a predetermined angle with respect to an axis of an exhaust pipe which communicates with the body; and a valve element contained in the body and having a larger diameter portion at a lower end for opening and closing a path in the exhaust pipe, the valve element being connected with an actuator such that the larger diameter portion of the valve element is engaged with an inner surface of the exhaust pipe when the valve element is closed, and that it is withdrawn from the path when it is opened.

According to the present invention, when the valve is opened, the valve element is withdrawn from the path for exhaust gas, thereby preventing increase in flow resistance and turbulence of exhaust gas to increase exhaust efficiency remarkably.

BRIEF DESCRIPTION OF THE DRAWINGS

The features and advantages of the present invention will become more apparent from the following description with respect to an embodiment as shown in appended drawing wherein:

FIGURE is a central vertical sectioned front view of one embodiment of the present invention.

DETAILED DESCRIPTION OF PREFERRED EMBODIMENTS

The drawing shows one embodiment in which a device of the present invention is used as an exhaust flow rate control valve, comprising a control valve "A" inclined at 45 degrees with respect to an axis of an exhaust pipe which will be described later, and an actuator "B" for driving the valve.

A body 1 of the control valve "A" comprises a hollow portion 1*a* which contains a valve element at the lower portion, a guide tube 2 an axis of which is inclined at the angle of 45 degrees at the upper portion and a flange 3 at the upper end. A horizontal short connecting pipe 4 at the lower end of the body 1 is connected between exhaust pipes 5 of an engine (not shown). The exhaust pipes 5 which hold the connecting pipe 4 communicate with a by-pass pipe 6. In the middle of the by-pass pipe 6, a butterfly control valve 7 is provided. An exhaust gas flows in directions of arrows.

A path 4*a* of the connecting pipe 4 has an elliptical vertical section, and an annular valve seat 8 coaxial with the guide tube 2 is provided in the path 4*a*. A valve element 9 comprises a valve head 9*a* having a larger diameter and a valve stem 9*b* at the upper portion. The valve stem 9*b* is slidably engaged in an axial bore 2*a* inclined at the angle of 45 degrees in the guide tube 2, and the valve head 9*a* is contained in the hollow portion 1*a*.

A tapered valve face 9*c* is formed at the lower circumferential end of the valve head 9*a*, and is engaged with valve seat 8 to seal the path 4*a*. On the flange 3, a cylindrical casing 10 which opens downward in the actuator "B" is bolted, and an air hole 11 which communicates with the inside of the casing 10 is formed in the flange 3. An air hole 12 for supplying compressed air is formed in the middle of the upper wall of the casing 10. A cylindrical piston 13 which opens at the lower end is slidably engaged in the casing 10.

A valve spring retainer 15 is provided via a cotter 14 at the end of the valve element 9 which gets into the piston 13, and a coil spring 16 is provided between the valve spring retainer 15 and the flange 3. The inner top surface of the piston 13 is always engaged with the upper end of the valve stem 9*b* by force of the coil spring 16. When the valve is opened, a stepped portion 18 between the valve head 9*a* and the valve stem 9*b* is engaged with the lower end of the guide tube 2, so that upward movement of the valve element 9 is limited. In this position, exhaust gas is prevented from getting into the axial bore 2*a*. When the valve element 9 is opened, the valve head 9*a* is withdrawn from the path 4*a* of the connecting pipe 9*a*.

In the foregoing embodiment, in a high speed rotation area of an engine, supply of compressed air is stopped by a selector valve (not shown), so that the valve element 1 is positioned at upper limit by force of the coil spring 16, and is fully opened. Thus, exhaust gas flows in the exhaust pipe 5 and the connecting pipe 4 without resistance to increase exhaust efficiency remarkably. When exhaust gas is reduced in low speed rotation area of an engine, compressed air is supplied into the cylinder 10 from a compressed air supply source (not shown) through the air hole 12, so that the valve element 9 moves down with the piston 13 to engage with the valve seat 8 while it compresses the coil spring 16. Accordingly, exhaust gas flows into the by-pass pipe 6, and goes to the exhaust pipe 5 at downstream portion via the fully opened butterfly control valve 7, thereby preventing exhaust turbulence and improving engine performance.

In the low speed rotation area, by adjusting a valve travel of the control valve 7 in the by-pass pipe 6 by an actuator (not shown), flow rate of exhaust gas is regulated minutely, thereby improving engine performance.

As mentioned above, the device of this invention is characterized by adjusting a substantial opening area of the exhaust pipe 5, thereby improving engine performance. When the valve element 9 is opened, it is completely withdrawn from the exhaust path, so that flowing resistance of exhaust gas is very small, thereby improving exhaust efficiency remarkably in high speed rotation.

The present invention may be applied to an exhaust shutter for an exhaust brake other than exhaust control valve as above. Furthermore, without the valve seat 8, the valve face 9*c* of the valve head 9*a* may be directly engaged with a tapered portion in the path 4*a*.

The foregoing merely relates to an embodiment of the present invention. Various changes and modifications may be made by person skilled in the art without departing from the scope of claims wherein:

What is claimed is:

1. An exhaust gas control device in an internal combustion engine, the device comprising:

a body in which an axis is inclined at a predetermined angle with respect to an axis of an exhaust pipe which communicates with the body; and a valve element contained in the body and having a larger diameter portion at a lower end for opening and closing a path in the exhaust pipe, the valve element being connected with an actuator such that the larger diameter portion of the valve element is engaged with an inner surface of the exhaust pipe when the valve element is closed, and such that it is withdrawn from the path when it is opened.

2. An exhaust gas control device as defined in claim 1 wherein the valve is a poppet valve which comprises a valve head as the larger diameter portion and a valve stem.

3. An exhaust gas control device as defined in claim 1 wherein the actuator comprises a cylindrical hollow piston which is moved downward by air given through an air hole and upward by a coil spring, an inner top end of the piston being engaged on an upper end of the valve element so that the valve element may be moved up and down.

4. An exhaust gas control device as defined in claim 1 wherein a by-pass pipe which has a control valve communicates with each side of a portion of the exhaust pipe having the valve element.

5. An exhaust gas control device as defined in claim 1 wherein a vertical section of the path in which an inside is engaged with the larger diameter portion of the valve element is elliptically formed and an axis of the valve element is inclined at an angle of 45 degrees with respect to the exhaust pipe.

* * * * *